US007547377B2

(12) United States Patent
Inamasu et al.

(10) Patent No.: US 7,547,377 B2
(45) Date of Patent: Jun. 16, 2009

(54) COKE OVEN REPAIRING APPARATUS

(75) Inventors: Hironobu Inamasu, Kakogawa (JP); Nobuki Takayama, Kakogawa (JP); Shunji Horinouchi, Kakogawa (JP); Hirofumi Yamashita, Kakogawa (JP)

(73) Assignee: Kansai Coke and Chemicals Co., Ltd., The, Amagasali-Shi (JP)

( * ) Notice: Subject to any disclaimer, the term of this patent is extended or adjusted under 35 U.S.C. 154(b) by 557 days.

(21) Appl. No.: 10/562,812

(22) PCT Filed: Feb. 28, 2005

(86) PCT No.: PCT/JP2005/003806

§ 371 (c)(1),
(2), (4) Date: Dec. 27, 2005

(87) PCT Pub. No.: WO2006/092867

PCT Pub. Date: Sep. 8, 2006

(65) Prior Publication Data

US 2007/0102278 A1 May 10, 2007

(51) Int. Cl.
*B01D 3/00* (2006.01)

(52) U.S. Cl. ..... 202/239; 202/241; 202/248; 202/270

(58) Field of Classification Search ..... 202/239, 202/248, 270, 133, 120, 241; 29/402.1, 559
See application file for complete search history.

(56) References Cited

U.S. PATENT DOCUMENTS 4,201,342 A * 5/1980 Stram ..... 239/128

(Continued)

FOREIGN PATENT DOCUMENTS

JP 60-18572 A 1/1985

(Continued)

OTHER PUBLICATIONS

Machine Translation of JP 2002-038159 published Feb. 6, 2002.*

(Continued)

*Primary Examiner*—Nina N. Bhat
(74) *Attorney, Agent, or Firm*—Birch, Stewart, Kolasch & Birch, LLP

(57) ABSTRACT

A coke-oven repairing apparatus comprising: a traveling carriage 3 which travels in the direction of coke oven battery with the carriage straddled on the rails placed on the top of a coke oven; a traversing carriage 4 provided on said traveling carriage 3, which moves in the direction orthogonal to the direction of coke oven battery; and a working device 5 for making repairs on the oven walls within the coke oven which is mounted on said traversing carriage 4, wherein the working device 5 includes: a guide post 31 which stands on the traversing carriage 4, and is also coupled, at its lower end portion, to a supporting portion provided on the traversing carriage through a pivot shaft 42; a lance 32 which ascends or descends along the guide post 31; and a derricking device 45 which tilts the guide post 31 between a forward-tilted posture and a backward-tilted posture using the pivot shaft 42 as the fulcrum to oscillate the lance 32 inserted in a coke-oven carbonizing chamber through a charging-hole, within the carbonizing chamber.

8 Claims, 14 Drawing Sheets

U.S. PATENT DOCUMENTS

| | | | | |
|---|---|---|---|---|
| 6,780,351 | B2 * | 8/2004 | Wirth, Jr. | 264/30 |
| 7,037,409 | B1 * | 5/2006 | Hippe et al. | 201/10 |

FOREIGN PATENT DOCUMENTS

| | | | |
|---|---|---|---|
| JP | 3-9955 | B2 | 2/1991 |
| JP | 8-3564 | A | 1/1996 |
| JP | 2000-136386 | A | 5/2000 |
| JP | 2001-131554 | A | 5/2001 |
| JP | 2001-181641 | A | 7/2001 |
| JP | 2002-38159 | A | 2/2002 |
| JP | 2002-285164 | A | 10/2002 |
| JP | 2004-331735 | A | 11/2004 |

OTHER PUBLICATIONS

Hidekuni ITO et al., information offer form for "Application of Hot Repairing Technology for the Central Region of Commerical Coke Oven Walls," Sumitomo Metals, vol. 44, No. 1, pp. 88-94, Jan. 1992.

* cited by examiner

COKE OVEN REPAIRING APPARATUS

TECHNICAL FIELD

The present invention relates to a coke-oven repairing apparatus suitable for making repairs on the inner walls of a coke oven.

BACKGROUND ART

A coke oven is configured to include carbonizing chambers and combustion chambers made of refractory bricks, wherein the carbonizing chambers and the combustion chambers are alternately placed in the direction of coke oven battery so that heat in the combustion chambers are transferred to the carbonizing chambers through the refractory bricks to cause dry distillation of charged coal within the carbonizing chambers to generate coke. Further, the charging of coal into the carbonizing chambers is performed through a coal-charging car which travels on the top of the coke oven in the direction of coke oven battery.

Such types of coke ovens have gone through over 30 years since they were built and thus become aged. However, reconstruction of such a huge coke-oven equipment would require enormous investments and long periods of construction works. Consequently, repairs are made on existing coke ovens for prolonging their lifetimes.

For making repairs on damaged portions (joint breakages or cracks) on refractory bricks constituting carbonizing chambers of coke ovens, it has been common to utilize thermal spraying methods.

As illustrated in FIG. 14, when operators 100, 101 manually make repairs, lances with lengths of 2 to 10 m are utilized for performing repairing operations. However, the operator 100 can support such a lance 102 with a length of about 1 m at a maximum, and a longer lance with a length of 4 m or more can not be supported by operators. Thus, as the operator 101 performs, a supporting pedestal 103 with supporting legs is placed within the oven and a long lance 104 is manipulated using the supporting pedestal 103 as the fulcrum.

Since such repairing operations using a long lance 104 require the supporting pedestal 103, the repairable range is limited to a lower part within the oven. This induces the problem that no repairs can be made for the range other than the range 105 that includes the repairable range of the operator 100 and the repairable range of the operator 101. Further, in the figure, 106 is a working device which moves up and down while carrying an operator.

Therefore, a repairing device 107 as illustrated in the left side of FIG. 14 has been developed and utilized. The repairing device 107 includes a carriage 111 which travels on rails 110 placed on an operating floor 109 of a coke oven 108 in the direction of coke oven battery, and a telescopic lance 112 is mounted on the carriage 111.

The base end portion 113 of the telescopic lance 112 is supported by a rotation shaft 115 provided on the upper portion of a supporting frame 114. By extending or contracting an extendable cylinder 116, the telescopic lance 112 can be oscillated in the upward or downward direction. Further, when the telescopic lance 112 is extended, a first lance 112*a* to a third lance 112*c* are drawn therefrom and, therefore, a lance head 117 at the lance tip end can reach to-be-repaired portions. From a thermal spraying nozzle within the lance head 117, a refractory material is sprayed to the to-be-repaired portion to repair the defective portion (refer to Japanese Unexamined Patent Publication No. 2001-181641).

However, even with the use of the repairing device 107, the operable range for repair is about 50% of the entire carbonizing chamber, thus un-repaired portion 118 within the oven is left.

Although, in theory, the aforementioned repairing device 107 can be placed at both the coke side (coke reception side) and the machine side (coke extrusion side) to enable making repairs all over the inside of the oven, it is not practical to introduce plural large-sized and expensive repairing device 107. Furthermore, the repairing device 107 generally utilizes rails for moving the working device thereon. Thus, if priority is put on repairing, the working device must be on standby, thus the working rate of the coke oven is reduced. If priority is placed on the movement of the working device, the repairing device 107 must be frequently on standby, thus the efficiency of repairing is reduced.

On the other hand, a repairing device 120 illustrated in FIG. 15 is configured to travel on rails 122 for a coal-charging car which are placed on the top of a coke oven 121. A traveling carriage 125 is supported on a pair of supporting rods 124, 124 with wheel 123 which roll on the rails 122 so that the traveling carriage 125 travels in the direction of coke oven battery. Further, on the traveling carriage 125, a traversing carriage 126 which traverses in the direction of oven length (the A direction) is provided.

A lance 127 provided on the traversing carriage 126 is configured to ascend and descend by being guided by a hoisting/lowering guide 128 standing on the traversing carriage 126. When a damaged portion within the oven is repaired, the traveling carriage 125 is moved in the direction of coke oven battery, while the traversing carriage 126 is moved in the direction of oven length, consequently the lance 127 is positioned just above a charging-hole of the carbonizing chamber, and the lance 127 is descended into the carbonizing chamber.

At the time when the tip end of the lance 127 reaches a to-be-repaired portion, the descent of the lance 127 is stopped, and a refractory material is sprayed from the thermal spraying nozzle provided at the tip end of the lance 127 for repairing the defective portion (refer to Japanese Unexamined Patent Publication No. 2002-38159, for example).

The repairing device 120 moves from a charging-hole to another charging-hole during repairing operations, thus enabling increasing the repairable range in comparison with the aforementioned repairing device 107.

However, the aforementioned repairing device 120 which descends the lance 127 is configured to descend the lance 127 through charging-holes with a diameter of about 40 to 50 cm, thus having the problem that the repairable range is limited to only near the descending path for the lance 127.

As described above, any of the conventional repairing devices 107 and 120 have unavoidably left non-repairable range on the oven wall.

The present invention was developed to overcome these problems of the conventional repairing devices and provides a coke-oven repairing apparatus capable of making repairs over a wider range of the carbonizing chamber oven wall without stopping the operation.

DISCLOSURE OF THE INVENTION

The present invention provides a coke-oven repairing apparatus comprising: a traveling carriage which travels in the direction of coke oven battery with the carriage straddled on the rails placed on the top of a coke oven; a traversing carriage provided on said traveling carriage, which moves in the direction orthogonal to the direction of coke oven battery; and a working device for making repairs on the oven walls within the coke oven which is mounted on said traversing carriage, wherein the working device includes: a guide post which stands on the traversing carriage, and is also coupled, at its lower end portion, to a supporting portion provided on the traversing carriage through a pivot shaft; a lance which ascends or descends along the guide post; and a lance oscillating means which oscillates the guide post between a forward-tilted posture and a backward-tilted posture using the pivot shaft as the fulcrum to oscillate the lance inserted in a coke-oven carbonizing chamber through a charging-hole, within the carbonizing chamber.

According to the present invention, a lance can be inserted through a charging-hole on the top of the oven, and the lance inserted in the carbonizing chamber can be oscillated in the direction of oven length, which widens the repairable range within the carbonizing chamber, thus solving the problem that un-repaired portions are left in the carbonizing chamber.

In the present invention, as the lance oscillating means, an extendable device which extends and contracts, and is coupled to the guide post and the traversing carriage can be provided.

Further, the lance oscillating means may be constituted by the extendable device and the traversing device. In this case, by slightly moving the traversing carriage in the direction of tilt of the guide post, it is possible to maximize the oscillating angle of the lance being inserted through a charging-hole, in the direction of oven length.

In the present invention, a control device which interlocks the extendable device and the traversing carriage may be provided. In this case, it is possible to efficiently perform the operation for maximizing the oscillating angle of the lance being inserted in the carbonizing chamber, within a range which prevents the lance from contacting the charging-hole.

In the present invention, when the lance is deflected, the control device may have the function of controlling, the amount of ascent or descent of the lance. In this case, it is possible to change the locus of movement of the tip end of the lance which is deflected in the direction of oven length to a straight line. For example, in the case of repairing joint breakages generated in the horizontal direction, it is possible to move the thermal spraying nozzle at the lance tip end in the horizontal direction, thus improving the repairing accuracy.

Further, by utilizing this function, it is possible to move the lance tip end in the vertical direction within the carbonizing chamber, thus enabling making repairs on joint breakages generated in the vertical direction with high accuracy.

In the present invention, the traveling carriage may include a traveling-carriage lift mechanism which lifts up the traveling carriage from the rails, and a slewing device which revolves the traveling carriage lifted from the rails to a standby position parallel to the rails. In this case, the repairing apparatus itself can move to a position parallel to the rails, namely a standby position.

In the present invention, the traveling-carriage lift mechanism may be constituted by a pedestal hung from the bottom portion of the traveling carriage and lifting cylinders coupled to the underframe of the traveling carriage and to the pedestal.

In the present invention, the extendable device also serves as a derricking device for raising or folding down the guide post on said traveling carriage. This enables performing the guide-post oscillating operation and the guide-post folding operation with a single means.

In the present invention, the outer contour dimension of said repairing apparatus may be determined such that the cross-sectional contour of said repairing apparatus orthogonal to the longitudinal direction does not interfere with the cross-sectional shape of a path opening portion which is penetrated through said coal-charging car in the direction of the travel thereof, at the state where said traveling carriage has been revolved to a standby position parallel to the rails and said guide post is folded on said traveling carriage. This enables placing the repairing apparatus on the oven in a manner which does not interfere with the travel of the coal-charging car.

Further, since the repairing apparatus can pass through the path of the coal-charging car, it is possible to move the repairing apparatus to an arbitrary side with respect to the coal-charging car without using equipment such as a crane or wrecker. This can eliminate the standby time of the coal-charging car and enables continuous operation of the coke oven without involving reduction of working ratio.

In the present invention, the traveling carriage may be configured to travel using rails for a coal-charging car which travels on the oven. This enables making repairs without involving restructure of existing equipment or implementation of rail-placing works for the repairing apparatus.

With the working device having the aforementioned configuration according to the present invention, it is possible to make repairs over a wider range of the oven walls of the carbonizing chamber of a coke oven without stopping operations.

BEST MODE FOR CARRYING OUT THE INVENTION

Figure 1:
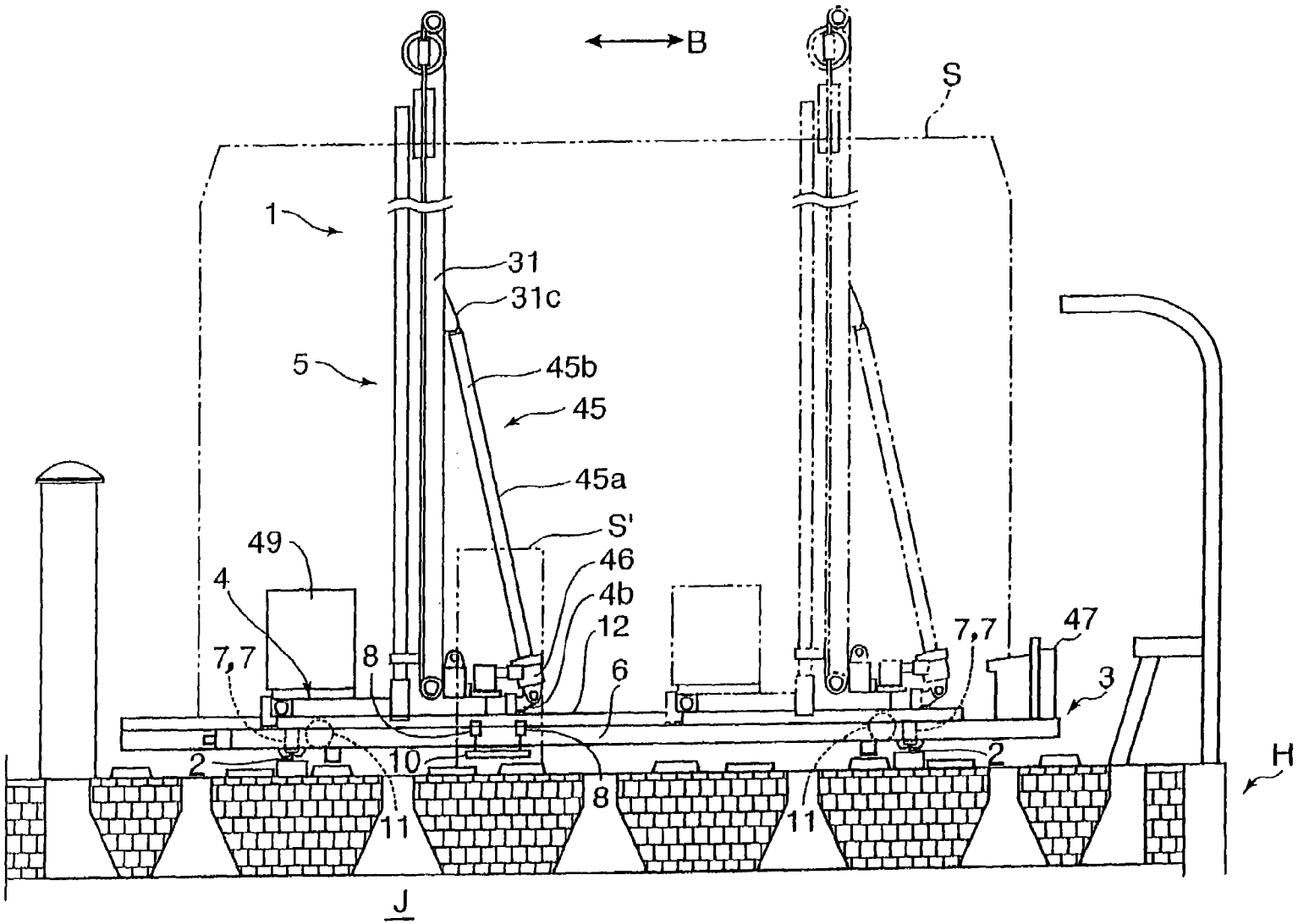
FIG. 1 is a front view illustrating the entire structure of a repairing apparatus according to the present invention.

Hereinafter, the present invention will be described in detail on the basis of embodiments illustrated in the drawings.

FIG. 1 illustrates a repairing apparatus according to the present invention which is placed on the top of a coke oven H. A coal-charging car for charging coal into a carbonizing chamber J is placed on the oven, and, in the figure, a two-dot chain line S represents the contour thereof. Further, S' is a path penetrating through the coal-charging car S in the direction of coke oven battery.

In the figure, the repairing apparatus 1 is mainly constituted by a traveling carriage 3 which straddles the rails 2, 2 placed on the oven along the direction of coke oven battery to travel on the rails, a traversing carriage 4 which is provided on the traveling carriage 3 and traverses in the direction of oven length (the direction of an arrow B), and a working device 5 mounted on the traversing carriage 4.

The traveling carriage 3 has a underframe 6 that includes a frame constructed in a window-frame shape, for example, by combining C-steels and I-steels, and a plurality of auxiliary frames (not shown in the drawing) each joining with the frame in the direction orthogonal to the longitudinal direction of the frame. Accordingly, the underframe 6 is configured in a ladder shape seen in a plan view.

A pair of wheels 7, 7 (only one of them at the front side is illustrated) are hung from each of the opposite end portions of the traveling carriage 3 in the longitudinal direction. The pair of wheels 7, 7 is rolled on the rail 2 while contacting the rail 2 at two points. The rails for traveling the coal-charging car are employed as the aforementioned rails 2.

Further, the traveling carriage 3 includes a traveling-carriage lift mechanism 8 for lifting the traveling carriage 3 to a height which spaces the wheels 7, 7 apart from the rails 2 and a slewing device 9 for slewing the traveling carriage 3 around a vertical axis while lifting the traveling carriage 3 up above the rails 2.

Figure 2:
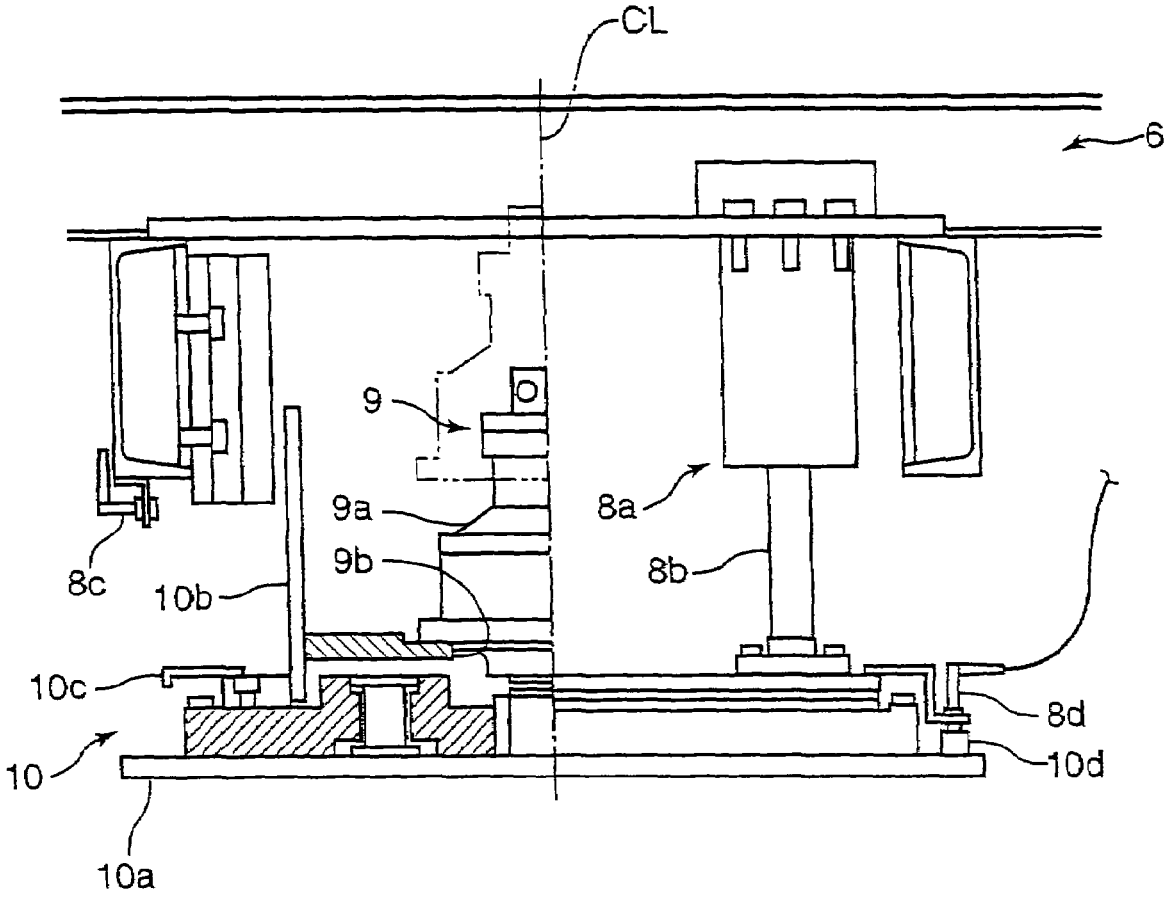
FIG. 2 is an enlarged view of a traveling-carriage lift mechanism illustrated in FIG. 1, including a cross section thereof.

FIG. 2 illustrates the structure of the traveling-carriage lift mechanism 8 in an enlarged manner.

The structure of the traveling-carriage lift mechanism 8 is illustrated at the right side of a center line CL, while the structure of the slewing device 9 housed within the traveling-carriage lift mechanism 8 is illustrated in a cross-sectional view at the left side.

The traveling-carriage lift mechanism 8 includes four lifting cylinders 8*b* (only the right front one is illustrated) which are placed substantially evenly along the perimeter while being oriented in the vertical direction (when the carriage 3 is viewed in a plan view), and a disc-shaped pedestal 10 fixed to the lower ends of the rods 8*b* of the respective lifting cylinders 8*a*.

The pedestal 10 has a bottom plate 10*a* which abuts on a supporting plate (not shown in the figure) mounted on the oven when the lifting cylinders 8*a* are extended. In the figure, it is illustrated that the lifting cylinders 8*a* are extended, namely the carriage 3 is lifted above the rails 2.

On the underframe 6 of the traveling carriage 3, a detection sensor 8*c* which detects a contraction limit when the lifting cylinders 8*a* are contracted is provided. When a detection plate 10*c* provided on a non-revolving frame 10*b* of the pedestal 10 enters the detection area of the detection sensor 8*c*, the detection sensor 8*c* outputs a detection signal for stopping the contraction operation of the lifting cylinders 8*a*.

The aforementioned non-revolving frame 10*b* is made of a cylindrical member with a bottom, and houses a revolving motor 9*a* as the slewing device 9. The driving shaft of the revolving motor 9*a* is penetrated through a through-hole 9*b* provided through the bottom plate of the non-revolving frame 10*b*, and is fixed on the center of the pedestal 10. Accordingly, when the revolving motor 9*a* is driven at a state where the lifting cylinders 8*a* are extended and therefore the traveling carriage 3 is lifted up above the rails 2, the traveling carriage 3 can be revolved.

Further, another detection sensor 8*d* is provided on the non-revolving frame 10*b*, while a detection plate 10*d* which is detected by the detection sensor 8*d* is provided on the pedestal 10. When the traveling carriage 3 is revolved by a predetermined angle and the detection sensor 8*d* detects the detection plate 10*d*, the detection sensor 8*d* outputs a signal for stopping the revolving operation.

The aforementioned respective sensors 8*c* and 8*d* may be constituted by high-frequency oscillation type, magnetic-type or capacitance type proximity sensors.

As described above, the traveling-carriage lift mechanism 8 can extend and contract the lifting cylinders 8*a* to lifted up the traveling carriage 3 above the rails 2, or place it on the rails 2. On the other hand, the slewing device 9 can revolve the traveling carriage 3 between a posture orthogonal to the rails 2 (the traveling posture) and a posture parallel to the rails 2 (standby posture) by revolving the revolving motor 9*a* in the normal or reverse directions with the traveling carriage 3 lifted up above the rails 2.

In FIG. 1, the pair of wheels 7, 7 at the left side in the figure having rotation shaft with sprocket, and a chain is strung around the sprocket so that the pair of wheels 7, 7 move in conjunction with each other, and one of the rotation shafts is coupled to the driving shaft of a traveling motor 11. The pair of wheels 7, 7 at the right side in the figure are configured in a similar way to aforementioned way, and are driven by the traveling motor 11. Accordingly, the total of four wheels 7 which are hung from the traveling carriage 3 constitute driving wheels.

Figure 3:
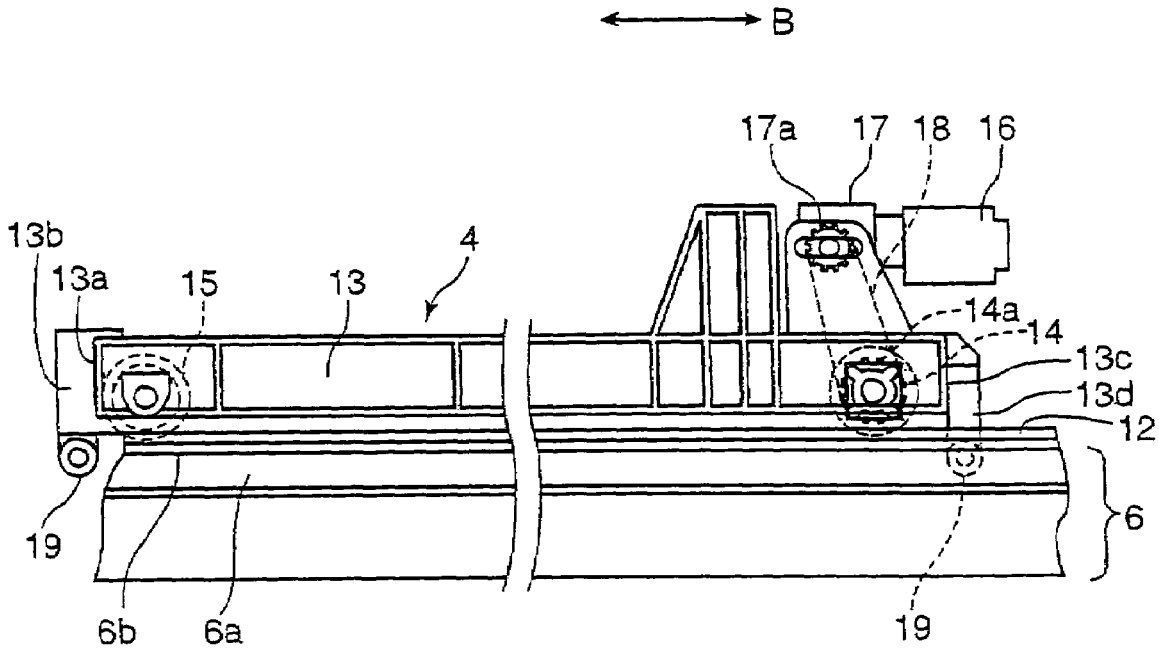
FIG. 3 is an enlarged view illustrating the structure of the traversing carriage illustrated in FIG. 1.

FIG. 3 illustrates, in an enlarged manner, the traversing carriage 4 illustrated in FIG. 1. Further, for ease of description, illustration of the operation device 5 is omitted.

In the same figure, traversing rails 12, 12 (only the front one is illustrated) are placed on the upper surface of the traversing carriage 3 in the longitudinal direction of the underframe 6, and the traversing carriage 4 travels on the traversing rails 12 in the direction of the oven length (the direction of arrow B).

The traversing carriage 4 includes an underframe 13 constructed in a window-frame shape, and wheels 14 and 15 are arranged at the opposite end portions of the underframe 13 in the longitudinal direction (the direction of the arrow B). 16 is an electric motor (hereinafter, referred to as a traversing motor) which is provided on the underframe 13, and the output shaft thereof is coupled to a reduction gear 17. The output shaft of the reduction gear 17 is provided with sprockets 17*a*.

On the other hand, the rotation shaft of the wheel 14 also has sprockets 14*a* fixed therearound, and a chain 18 is strung around the sprockets 14*a* and the aforementioned sprockets 17*a*. Accordingly, the wheel 14 forms a driving wheel for traversing the traversing carriage 4 while the wheel 15 forms an idler wheel.

Further, a pair of brackets 13*b*, 13*a* (only the front one is illustrated) are hung from one end face 13*a* of the underframe 13 in the longitudinal direction, and guide wheels 19 are provide on the lower ends of the respective brackets 13*b*. The guide wheels 19 rotate in contact with the lower surface of an upper rib 6*b* of a frame 6*a* with an I-shaped cross section constituting the underframe 6, which prevents the traversing carriage 4 from derailing from the traversing rails 12. Similarly, brackets 13*d*, 13*d* including guide wheels 19 are also provided on the other end face 13*c* of the underframe 13 in the longitudinal direction. The aforementioned traversing motor 16 and the transfer mechanism for transferring the rotational force of the traversing motor 16 to the wheel 14 function as the traversing device.

Figure 4:
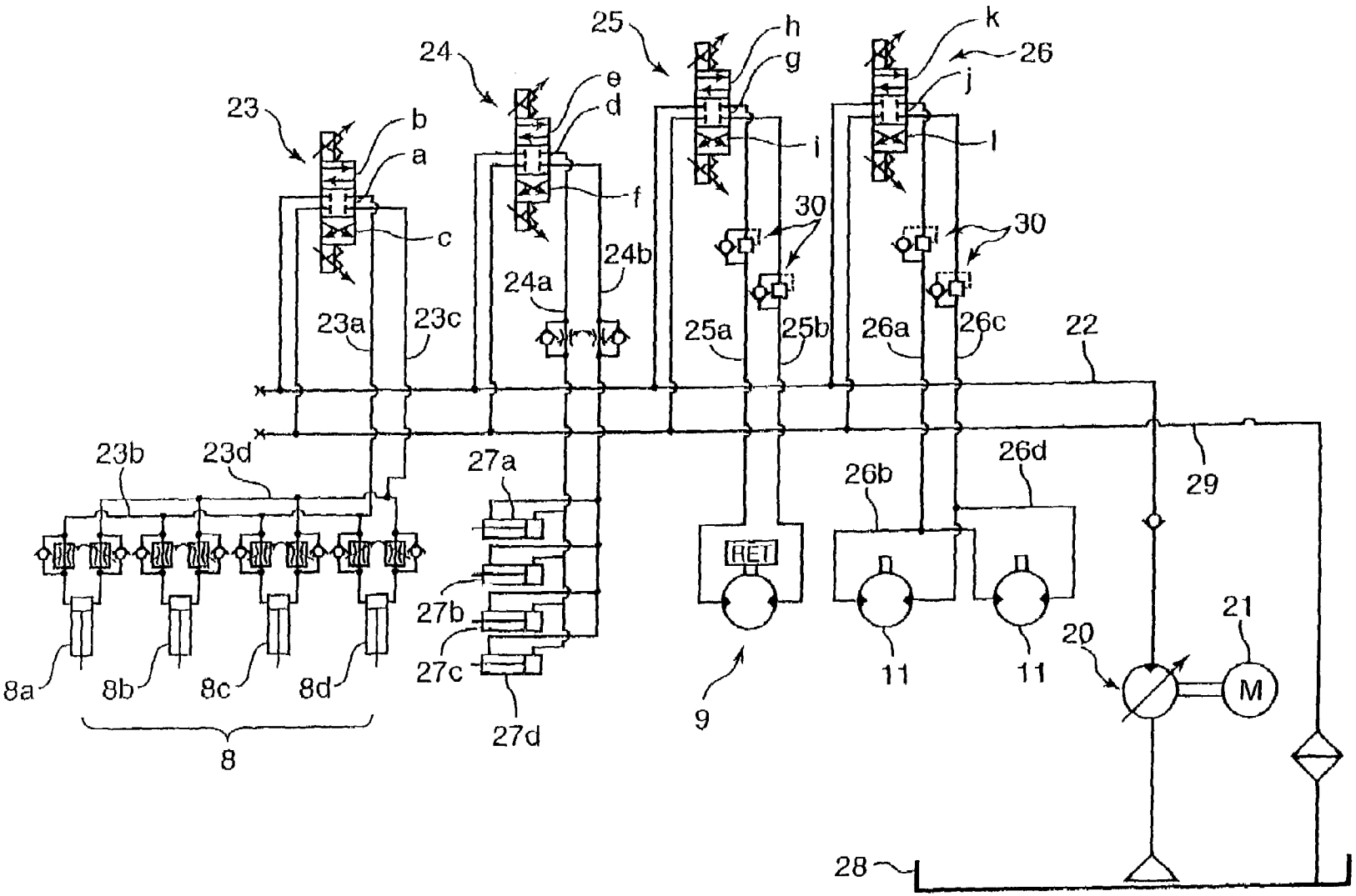
FIG. 4 is a hydraulic circuit of hydraulic actuators provided in the repairing apparatus.

FIG. 4 illustrates a hydraulic circuit for operating each of the aforementioned hydraulic actuators.

In the same figure, 20 is a variable-displacement type hydraulic pump, which operates using a DC motor 21 as a driving power supply.

Hydraulic oil discharged from the hydraulic pump 20 is supplied through a fluid path 22 to: a lifting control valve 23 for lifting and lowering the traveling carriage 3, a fixing control valve 24 for fixing the traversing carriage 3 during repairing operations, a slewing control valve 25 for revolving the traversing carriage 3, and a traveling control value 26 for causing the traveling carriage 3 to travel on the rails 2.

Further, the aforementioned DC motor 21 may be driven by using a rechargeable battery mounted on the traveling carriage 3 as a power supply. When the remaining charge in the rechargeable battery is reduced, the DC motor 21 may also be driven through a cable connected to an electric-power terminal mounted on the oven.

The lifting control valve 23 has switchable positions for middle a, lifting b, and lowering c. When it is switched to the lifting b, hydraulic oil is introduced through the fluid paths 23*a* and 23*b* to the head sides of the respective lifting cylinders 8*a* to 8*d* to extend the rods, thus pushing down the pedestal 10 coupled to the rods. On the other hand, when it is switched to the lowering c, hydraulic oil is introduced through the fluid paths 23*c* and 23*d* to the rod sides of the respective lifting cylinders 8*a* to 8*d* to contract the rods, thus lifting the pedestal 10 coupled to the rods.

The fixing control valve 24 has switchable positions for middle d, clamping e and unclamping f. When it is switched to the clamping e, hydraulic oil is introduced through the fluid path 24*a* to the head sides of respective clamping cylinders 27*a* to 27*d* to extend the rods, which causes the closing operation of clamping pawls (which will be described later) coupled to the respective rods, thus holding the rail 2. On the other hand, when it is switched to the unclamping f, hydraulic oil is introduced through a fluid path 24*b* to the rod sides of the respective clamping cylinders 27*a* to 27*d* to contract the rods, which causes the opening operation of the clamping pawls, thus releasing the held rail 2. The aforementioned clamping operation is for fixing the traveling carriage 3 to the rail 2 to stabilize the repairing apparatus 1 during the operating state.

Figure 5:
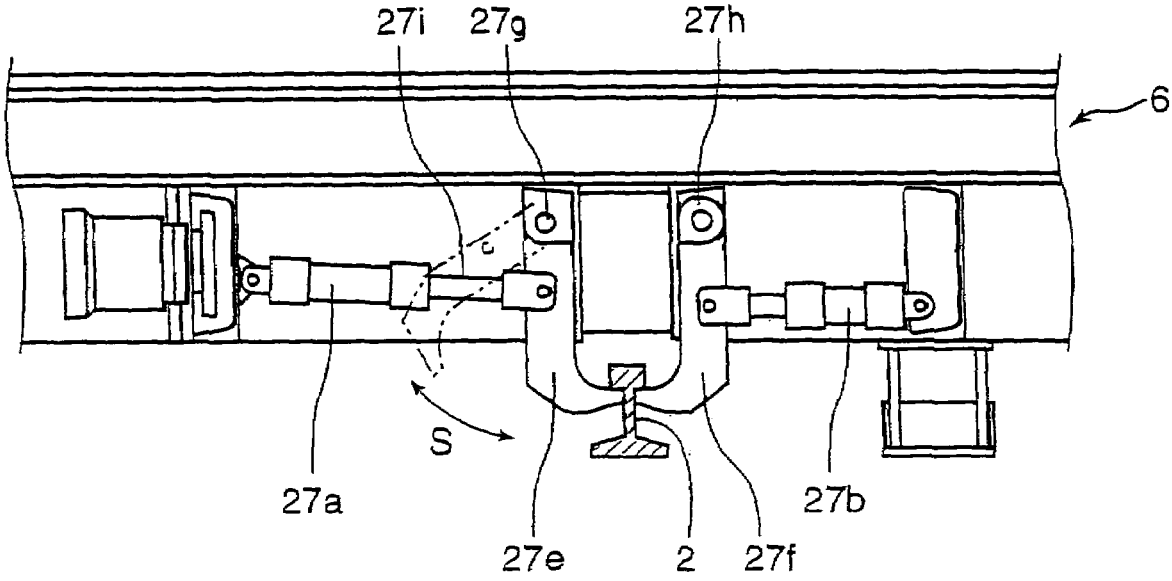
FIG. 5 is an enlarged view illustrating a clamping mechanism provided on the traveling carriage.

FIG. 5 illustrates the clamping and the unclamping operation by representatively illustrating the clamping cylinders 27*a* and 27*b*.

In the figure, the clamping pawls 27*e* and 27*f* are placed on the underframe 6 of the traveling carriage 3 with the rail 2 sandwiched therebetween. The clamping pawl 27*e* is hung through a supporting shaft 27*g* provided on the underframe 6. The rod 27*i* of the clamping cylinder 27*a* is coupled to the clamping pawl 27*e* below the supporting shaft 27*g*, which enables slewing the clamping pawl 27*e* in the direction of an arrow S through the extension and contraction of the clamping cylinder 27*a*.

Accordingly, if the clamping cylinders 27*a* and 27*b* are both extended, this will cause the clamping pawls 27*e* and 27*f* to close with each other to sandwich the rail 2 at the both sides, thus fixing the rail 2. In the figure, the two-dot chain line represents the clamping pawl 27*i* lying at the clamp position during unclamping. Further, the clamping cylinders 27*c* and 27*d* operate in a similar way to the aforementioned way to cause the clamping operation or the unclamping operation for the other rail 2.

Returning to FIG. 4, the description will be continued.

The slewing control valve 25 has switchable positions for middle g, clockwise revolution h and counter-clockwise revolution i. When it is switched to the clockwise revolution h, hydraulic oil is introduced through the fluid path 25*a* to the revolving motor 9, thus causing the clockwise revolution of the traveling carriage 3. On the other hand, when it is switched to the counter-clockwise revolution i, hydraulic oil is introduced through the fluid path 25*b* to the revolving motor 9 from the opposite direction, thus causing the counter-clockwise revolution of the traveling carriage 3.

The traveling control valve 26 has switchable positions for middle j, southward-traveling k and northward-traveling l. When it is switched to the southward-traveling k, hydraulic oil is introduced through the fluid paths from 26*a* to 26*b* to the traveling motors 11, 11 in parallel, thus causing the traveling carriage 3 to travel southwardly. On the other hand, when it is switched to the northward-traveling l, hydraulic oil is introduced through the fluid paths from 26*c* to 26*d* to the traveling motors 11, 11 in parallel, from the opposite direction, thus causing the traveling carriage 3 to travel northwardly.

Further, while in the present embodiment the direction of travel is the southward and northward directions since the direction of the coke oven battery is the southward and northward direction, the direction of travel of the traveling carriage 3 is not limited to such a direction. Further, in the figure, 28 is a tank which stores hydraulic oil and receives oil returned thereto, 29 is a return oil path communicated to the tank 28, and 30 is a counterbalance valve.

Figure 6:
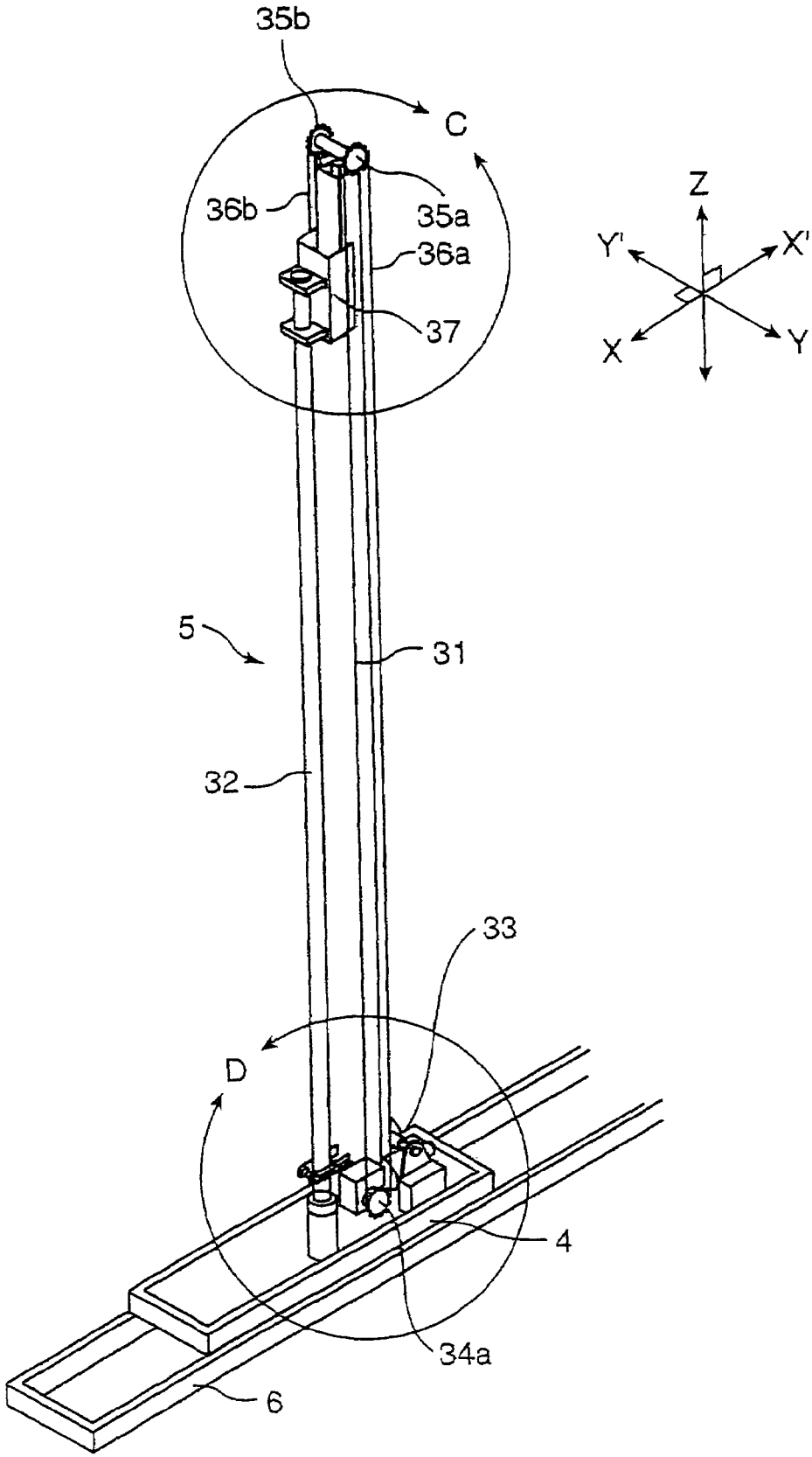
FIG. 6 is a perspective view illustrating the structure of a working device mounted on the traversing carriage.

FIG. 6 illustrates the structure of the working device 5 mounted on the traversing carriage 4.

The working device 5 includes a rectangular cylindrical guide post 31 standing from the traversing carriage 4 and a lance 32 capable of moving up and down along the guide post 31.

At the both sides (in the Y-Y' direction) of the lower portion of the guide post 31, a pair of driving sprockets 34*a*, 34*b* (only one of them at the front side is illustrated) which are rotated by an electric motor 33 with a reduction gear are provided. At the both sides (in the Y-Y' direction) of the upper portion of the guide post 31, a pair of idler sprockets 35*a*, 35*b* are provided.

Endless chains 36*a* and 36*b* are respectively strung and run around the driving sprocket 34*a* and the idler sprocket 35*a*, and the driving sprocket 34*b* and the idler sprocket 35*b*. A lift mechanism 37 is fixed to a portion of the chains 36*a* and 36*b*.

Figure 7:
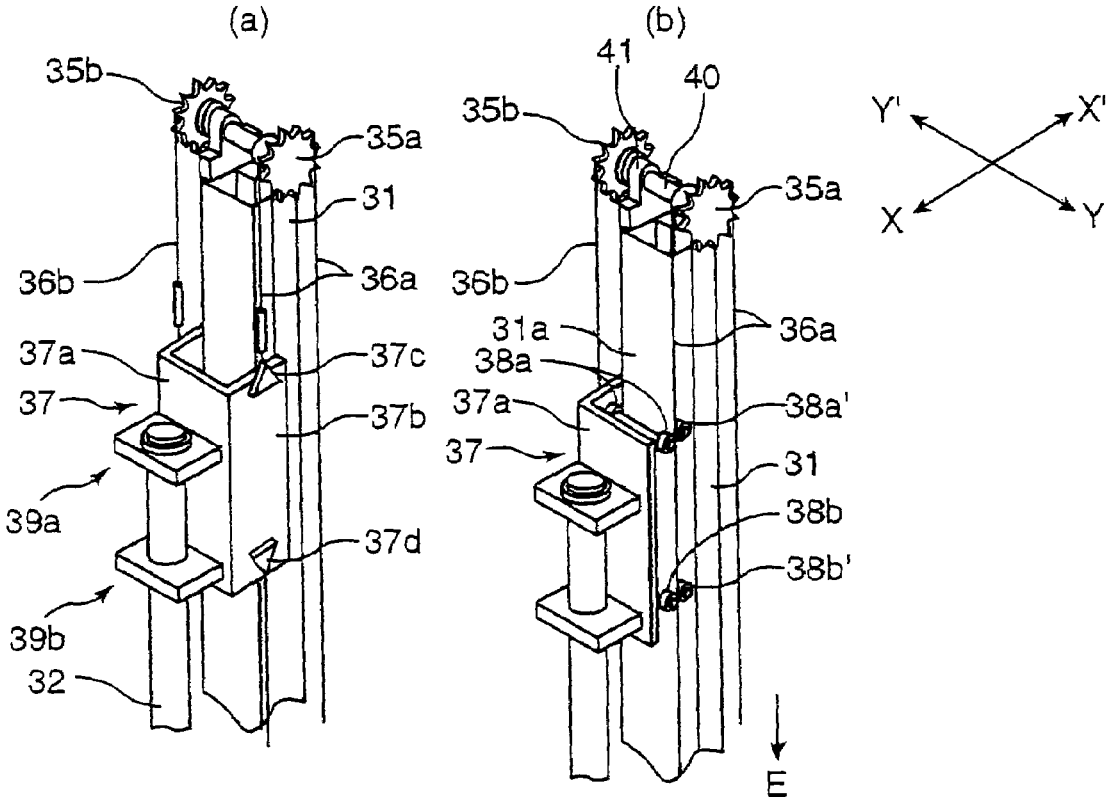
FIG. 7(*a*) illustrates an enlarged view illustrating the guide post upper portion illustrated in FIG. 6, and FIG. 7(*b*) is a partially cutaway enlarged view illustrating the structure of the lift mechanism.

FIG. 7 illustrates, in an enlarging manner, the upper portion of the guide post (the portion C in FIG. 6), wherein (a) illustrates an external view and (b) illustrates the internal structure thereof with the lift mechanism 37 cutaway.

In both the views, the lift mechanism 37 includes a cover 37*a* having a shape of a square with one side open in a plan view, wherein the chain 36*a* is fixed, at its one end, to an upper fixing portion 37*c* provided on a side surface 37*b* of the cover 37*a*, and also fixed at the other end to a lower fixing portion 37*d*. On the side surface at the rear side, similarly, an upper fixing portion 37*c* and a lower fixing portion 37*d* are provided and the chain 36*b* is fixed to them.

As illustrated in FIG. 7(*b*), plural wheels which rotate with the front-side rib plate 31*a* (in the X-X' direction) sandwiched therebetween are provided, within the cover 37*a*.

Specifically, upper wheels 38*a*, 38*a* placed on the inner wall of the cover 37*a* at an upper portion thereof, and lower wheels 38*b*, 38*b* placed on the inner wall at a lower portion thereof roll along the outer surface of the front-side rib plate 31*a*, while upper wheels 38*a'*, 38*a'* and lower wheels 38*b'*, 38*b'* which are symmetrically placed about the rib plate 31*a* roll along the inner surface of the front-side rib plate 31*a*.

Consequently, the lift mechanism 37 moves up when the chains 36*a* and 36*b* go therearound in the direction of an arrow E, while the lift mechanism 37 moves down when they go therearound in the direction opposite from the arrow E.

Further, an upper fixing member 39*a* and a lower fixing member 39*b* are placed on the outer surface of the cover 37*a* such that they are spaced apart from each other, and the upper end portion of the lance 32 is fixed to these fixing members 39*a*, 39*b*.

In the figure, 40 is a rotation shaft which couples the idler sprockets 35*a*, 35*b* to each other in the Y-Y' direction, and this rotation shaft 40 is supported by a bearing 41 provided on the upper end of the guide post 31.

Figure 8:
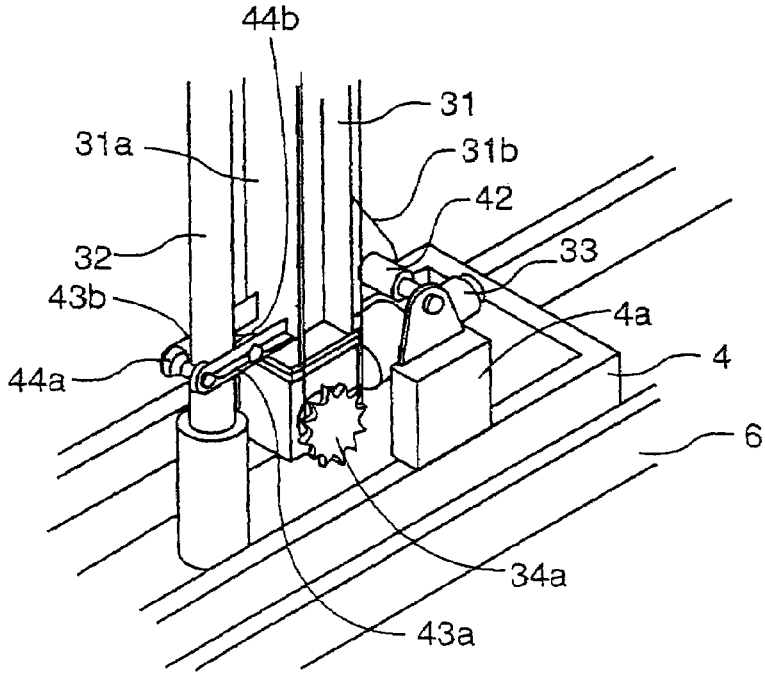
FIG. 8 is an enlarged view illustrating the structure of the guide post lower portion.

FIG. 8 illustrates, in an enlarged manner, the guide post lower portion (the portion D in FIG. 6).

In the same figure, a bracket 31*b* is provided at the lower portion of the guide post 31 such that it is oriented in the X-X' direction, and a pivot shaft 42 is penetrated through the bracket 31*b* in the Y-Y' direction. The shaft ends of the pivot shaft 42 are pivotally supported by the supporting frames 4*a*, 4*a* (only the front one is illustrated) standing from the traversing carriage 4.

A pair of arms 43*a* and 43*b* is protruded in parallel from the lower portion of the front-side rib plate 31*a* in the X direction. Supporting rollers 44*a* and 44*b*, which support the lance 32 such that it can move up and down, are provided with respect to the arms 43*a* and 43*b*. The supporting rollers 44*a*, 44*b* are formed to have an hourglass-shaped center portion such that they can sandwich the pipe-shaped lance 32 at the opposite sides in the X-X' direction while allowing it to slide.

The guide post 31 including the aforementioned lift mechanism 37 is capable of being displaced between a vertically-raised posture and a horizontally-folded posture through a derricking device 45, as illustrated in FIG. 1.

Therefore, the derricking device 45 includes a cylinder portion 45*a* which operates to extend and contract (extending/contracting device) wherein one end thereof is coupled to a substantially middle portion of the guide post 31 through a bracket 31*c* while the other end is coupled to a bracket 4*b* extended from the traversing carriage 4. Consequently, by rotating an electric motor 46 in the normal direction or the reverse direction, the rod 45*d* can be extended or contracted to raise or fold the guide post 31.

In order to increase the oscillating angle of the lance 32 within the carbonizing chamber, the present embodiment produces a movement of the oscillation fulcrum through travel of the traversing carriage 4 as well as oscillation of the guide post 31 through the derricking device 45. Thus, the derricking device 45 and the traversing carriage 4 function as the lance oscillating means.

Figure 9:
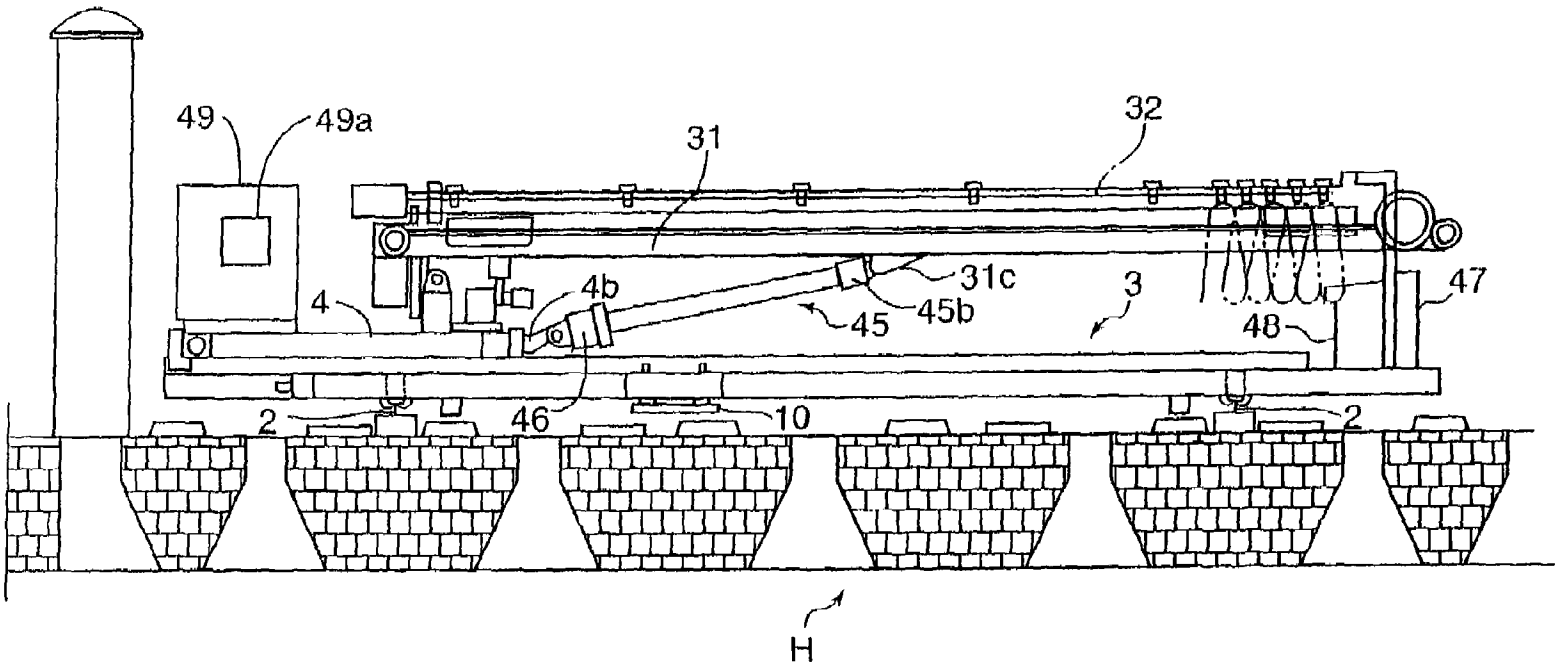
FIG. 9 is a front view illustrating a state where the guide post is folded down.

FIG. 9 illustrates a state where the guide post 31 is folded. In the same figure, 47 is a traveling-carriage control board which is provided at one end portion of the traveling carriage 3 in the longitudinal direction, to operate the respective hydraulic actuators for lifting, revolving and moving the traveling carriage 3. 48 is a machine case housing the hydraulic units. The respective hydraulic actuators can be remotely operated by a remote controlling device which is connected to the traveling-carriage control board 47 through a cable.

Further, 49 is a traversing-carriage control board which is provided at the other end portion of the traversing carriage 4 in the longitudinal direction to control the traversing motor 16, the electric motor 33 for hoisting or lowering the lance 32, the electric motor 46 for raising or folding the guide post 31 and the like. The electric motors 16, 33 and 46 are of a pulse-controlled type. Further, the traversing-carriage control board 49 includes a controller 49*a* (which will be described later) as a control device for controlling the electric motors 16, 33 and 46. A joystick (not shown) which enables generation of commands through remote operation is connected to the controller 49*a* through a cable.

Figure 10:
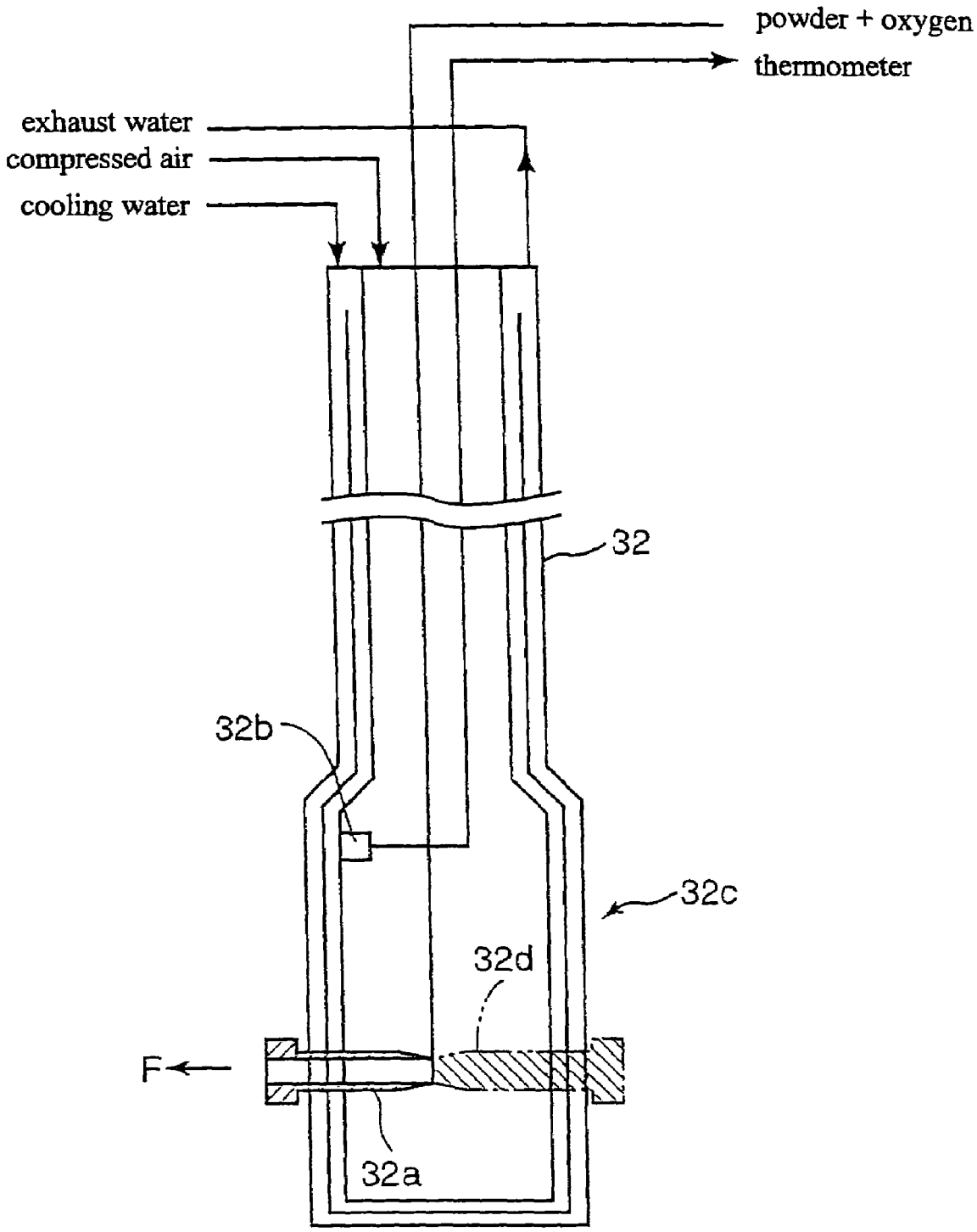
FIG. 10 is a longitudinal cross-sectional view illustrating the configuration of the lance.

Next, the basic configuration of the lance 32 will be described, with reference to FIG. 10.

In the same figure, the lance 32 is constituted by a double pipe, wherein cooling water is supplied into the inner pipe while exhaust water which has been used for cooling is discharged from the outer pipe.

A thermal spraying nozzle 32*a* is horizontally placed at a lower portion in the lance 32, and this thermal spraying nozzle 32*a* is supplied with oxygen and thermal spray material made of refractory materials and metal powders in a mixed state. A resistance temperature sensor 32*b* is provided near the thermal spraying nozzle 32*a*. Signals of the measured temperature measured with the resistance temperature sensor 32*b* are output to an external thermometer.

Further, at the tip end portion 32*c* of the lance at the opposite side from the direction of spraying of the thermal spraying nozzle 32*a* (the F direction), a plug 32*d* for guiding thermal spray material only in the direction of arrow F is mounted. In the case where it is desired to change the direction of thermal spraying to the direction opposite from the direction of arrow F, the positions of the thermal spraying nozzle 32*a* and the plug 32*d* can be interchanged, and thus, the direction of thermal spraying can be easily changed.

Figure 11:
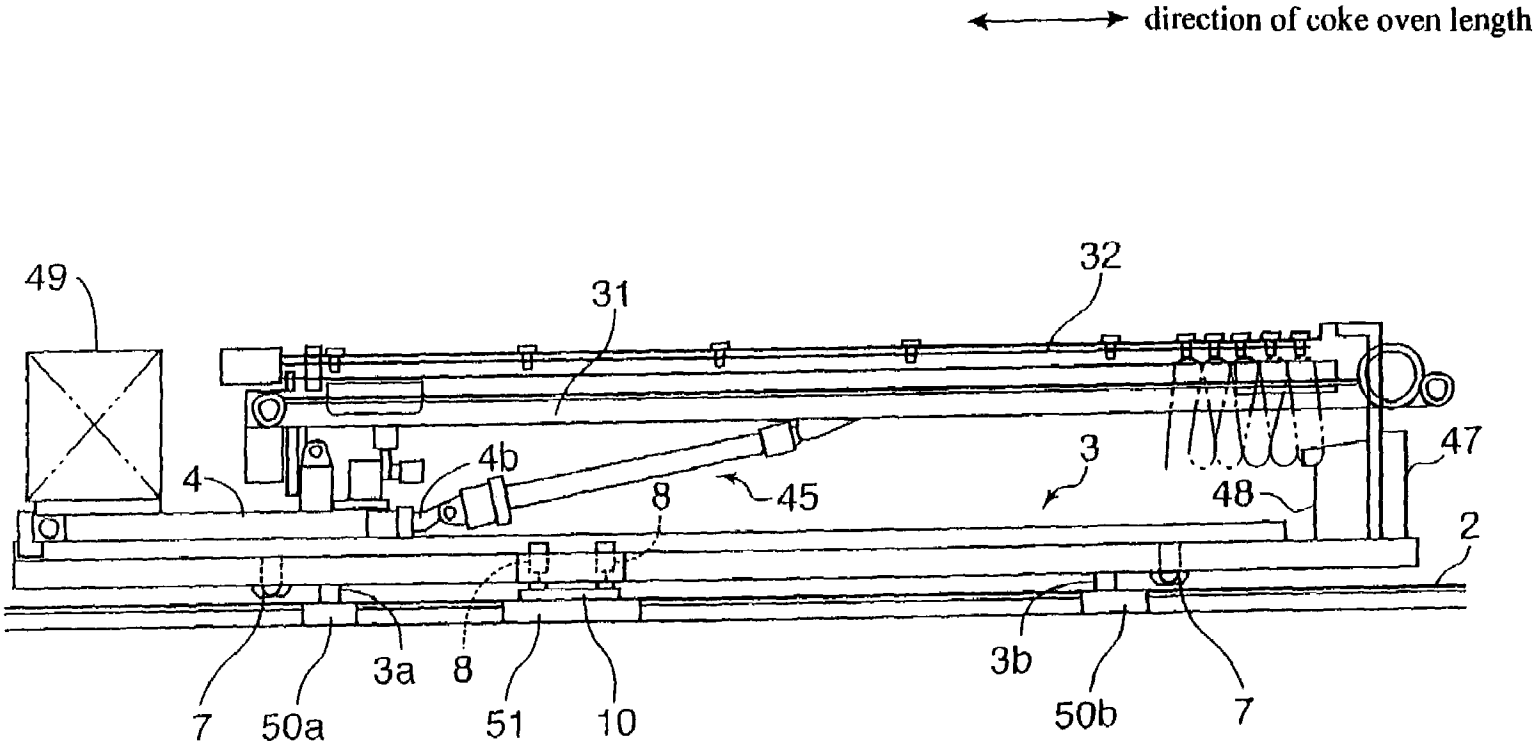
FIG. 11 is an explanation view illustrating a standby state of the repairing apparatus.

Subsequently, the operation of the repairing apparatus 11 having the aforementioned structure will be described with reference to FIG. 11.

Further, the description will be given on the precondition that the traveling carriage 3 of the repairing apparatus 1 is on standby in a posture parallel to the rails 2, and fixing legs 3*a* and 3*b* hung from the traveling carriage 3 are supported on installation bases 50*a* and 50*b* provided on the oven. Further, the pedestal 10 is spaced apart from the supporting plate 51.

At the start of a repairing operation, the lifting cylinders 8*a* to 8*d* of the traveling-carriage lift mechanism 8 are extended, thus lowering the pedestal 10 toward the supporting plate 51. At the state where the pedestal 10 abuts on the supporting plate 51, the lifting cylinders 8*a* to 8*d* are further extended to separate the fixing legs 3*a* and 3*b* from the installation bases 50*a* and 50*b*, thus causing the repairing apparatus 1 to lift up.

At this state, the revolving motor 9*a* is driven to let the traveling carriage 3 to rotate until the traveling carriage 3 is brought into the posture orthogonal to the rails 2, 2, that is, until the traveling carriage 3 straddles the rails 2, 2.

After the completion of the revolution, the lifting cylinders 8*a* to 8*d* are contracted to lower the traveling carriage 3, thus placing the wheels 7, 7 mounted at the opposite end portions of the traveling carriage 3 in the longitudinal direction onto the rails 2, 2. This enables the traveling carriage 3 to travel on the rails 2, 2 in the direction of coke oven battery.

FIG. 9 illustrates a state where the repairing apparatus 1 has traveled to a carbonizing chamber to be repaired.

Next, the derricking device 45 is driven to extend the rod 45*b*, thus raising the guide post 31 substantially vertically.

Figure 12:
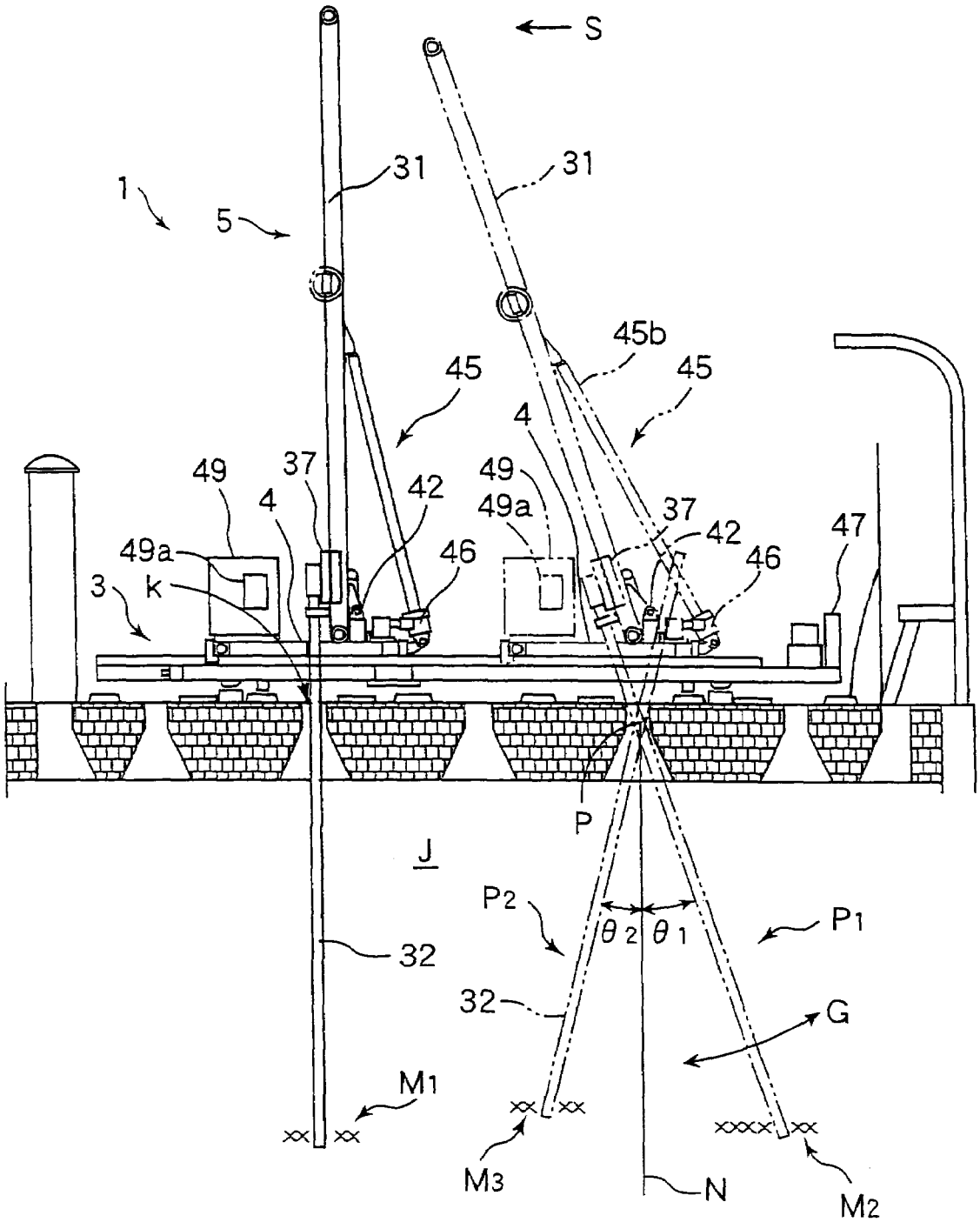
FIG. 12 is an explanation view illustrating an operating state of the repairing apparatus.

FIG. 12 illustrates a state where the repairing apparatus 1 is operated, a state where the lance 32 is descended in the carbonizing chamber J (the repairing apparatus 1 illustrated at the left side of FIG. 1), and a state where the lance 32 is oscillated within the carbonizing chamber J (the repairing apparatus 1 illustrated at the right side of FIG. 1), are currently illustrated.

Before descending the lance 32 into the carbonizing chamber J, the tip end of the lance 32 is positioned at the center of a charging-hole K using a template. With the positioning, a zero offset of the coordinate axis is determined. Then, the offset coordinate axis is sent to the controller 49*a* in the traversing-carriage control board 49.

The controller 49*a* pre-stores profile data for respective carbonizing chambers (the diameter of the charging-holes, the depth of the charging-holes, the depth of the carbonizing chambers, etc.). On the basis of the profile data and the current coordinate of the lance 32 which is moved from the zero point of the coordinate axis, the position of the lance 32 inserted in the carbonizing chamber J relative to the wall surfaces of the carbonizing chamber can be identified.

When the tip end of the lance 32 reaches a defective portion $M_1$, the descent of the lance 32 is stopped, and the thermal spray material is sprayed from the thermal spraying nozzle 32*a*.

For defective portions near the vertical descending path for the lance 32, the aforementioned method can be utilized for making repairs thereon.

Next, a case where a detective portion $M_2$ exists at a position deviated from the descending path for the lance 32 in the direction of coke oven length will be described. An operator generates a command for tilting the lance 32 by an angle of $\theta_1$ with respect to a vertical axis N (an imaginary line drawn in the vertical direction from the center of the charging-hole K) by manipulating the joystick.

Figure 13:
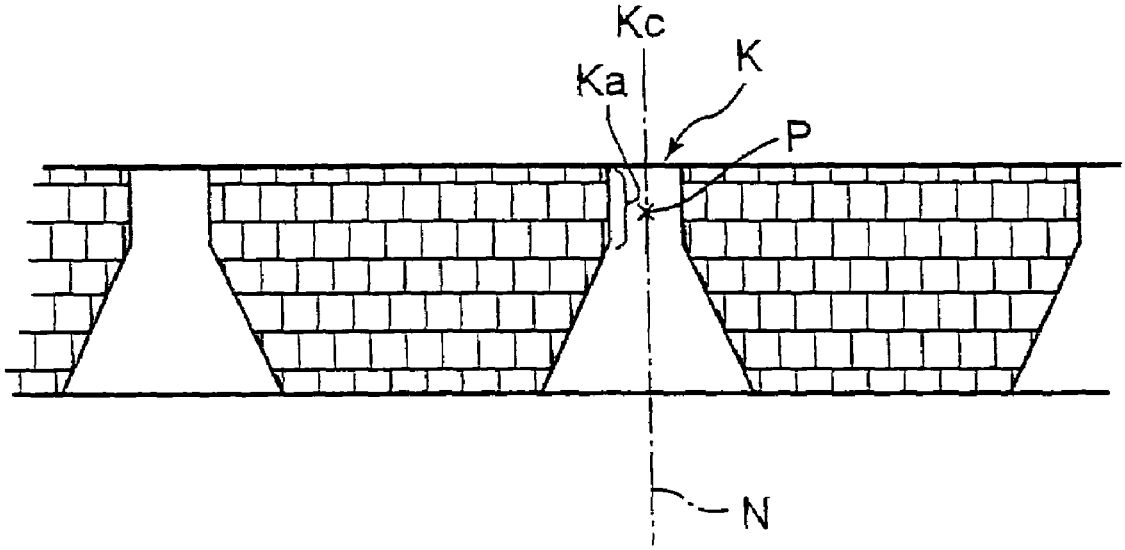
FIG. 13 is an explanation view illustrating the fulcrum of oscillation of the lance.
Figure 14:
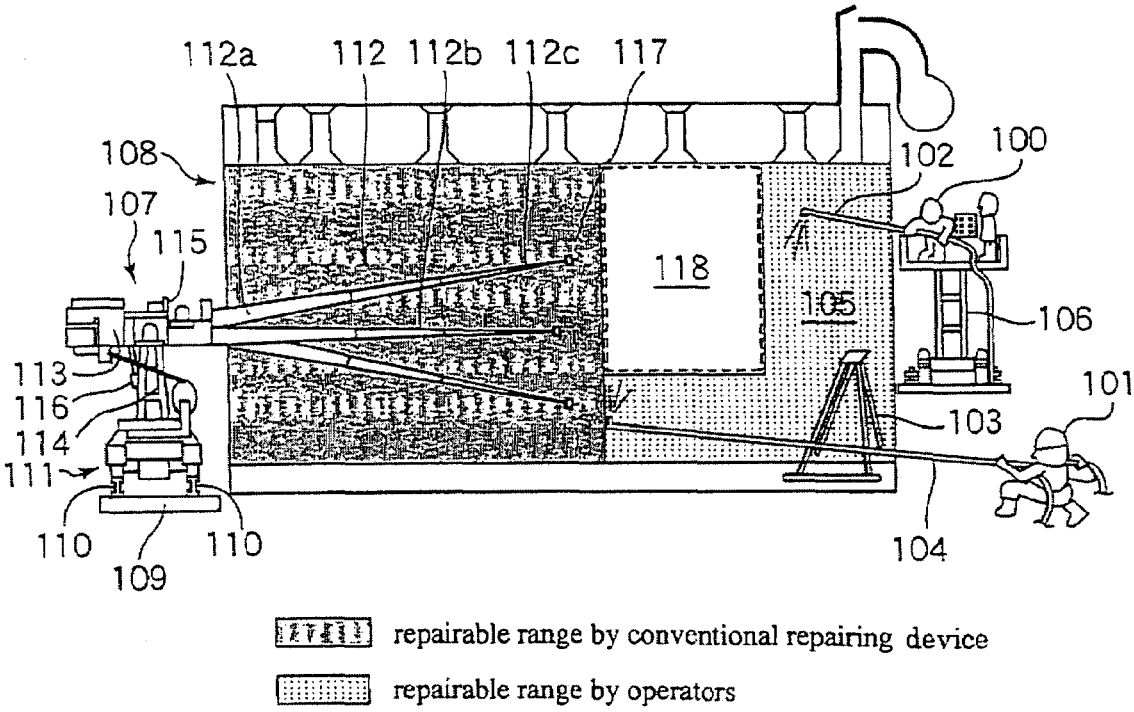
FIG.14 PRIOR ART
FIG. 14 is an explanation view illustrating an operating state of a conventional repairing apparatus.
Figure 15:
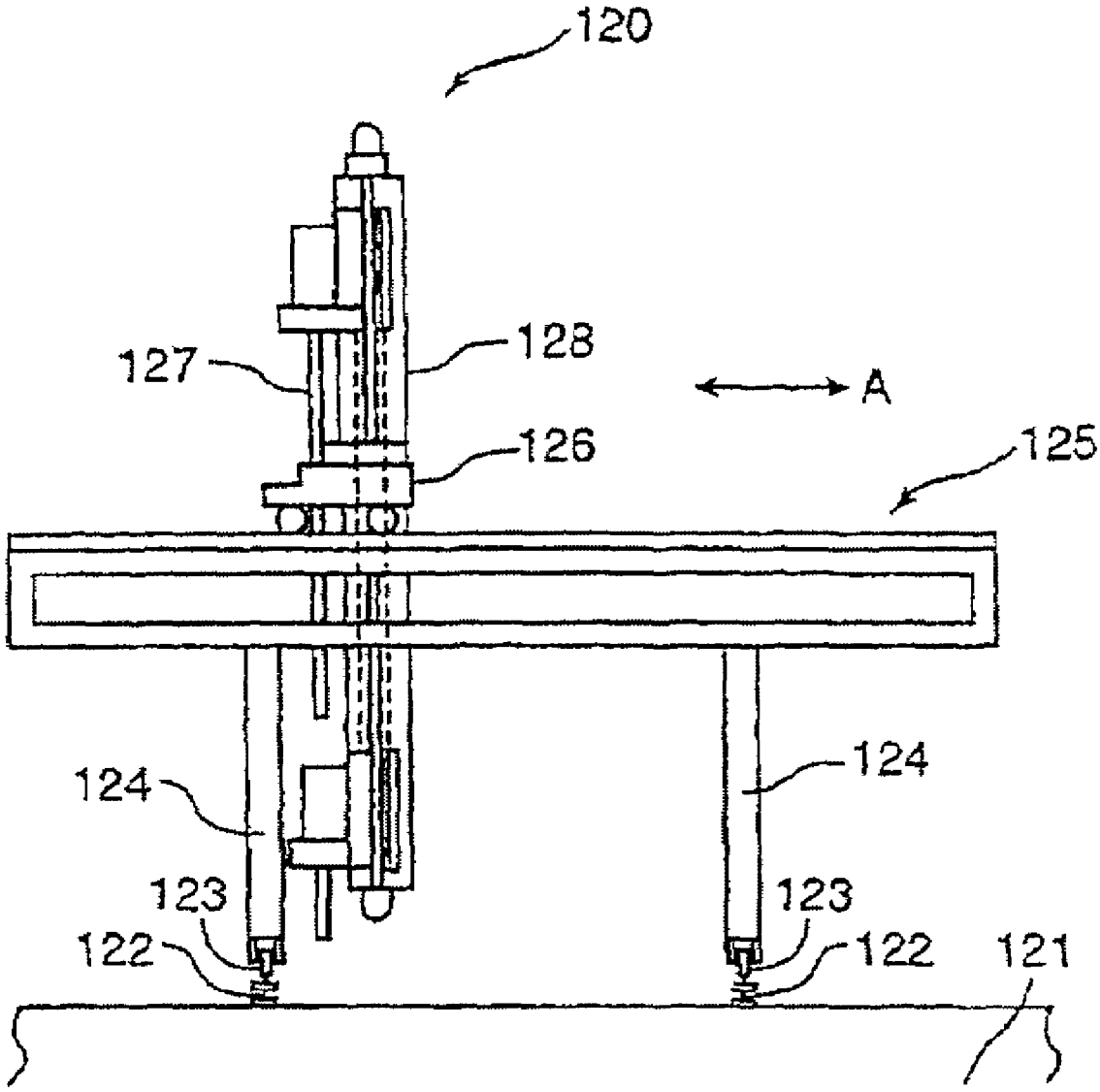
FIG.15 PRIOR ART
FIG. 15 is a front view illustrating the structure of another conventional repairing apparatus.

At this time, the controller 49*a* sets the fulcrum P of the lance 32 to be tilted to the center Kc of the charging-hole K and also to the depthwise center of the cylindrical portion Kd of the charging-hole K (see FIG. 13), and interlocks the driving of the electric motor 46 and the driving of the traversing motor 16 for controlling the posture of the lance 32 such that the center of the lance 32 to be tilted is not deviated from the fulcrum P.

More specifically, in the case where the lance 32 is tilted by the angle $\theta_1$ into a forward tilting posture P1, the electric motor 46 is driven to extend the rod 45*b* of the derricking device 45 thus tilting the guide post 31 in the direction of arrow S while the traversing motor 16 is driven to cause the traversing carriage 4 to slightly traverse in the direction of arrow S.

On the contrary, in the case where the lance 32 is tilted by an angle of $\theta_2$ into a backward tilting posture $P_2$ in order to repair a defective portion $M_3$, the electric motor 46 is driven to contract the rod 45*b* of the derricking device 45 thus tilting the guide post 31 in the direction opposite from the arrow S while the traversing motor 16 is driven to cause the traversing carriage 4 to slightly traverse in the direction opposite to the arrow S.

The controller 49*a* controls the aforementioned operation for deflecting the guide post 31 and the operation for traversing the traversing carriage 4 back and forth.

Also, when the lance 32 is oscillated in the G direction, the controller 49*a* controls the lance 32 such that the locus of movement of the thermal spraying nozzle 32*e* becomes a horizontal straight line.

In other words, when the lance 32 is tilted from the vertical posture to the forward tilting posture $P_1$ with the height of the lance 32 maintained constant, the locus of the tip end of the lance 32 draws an arc shape. With this method, it is impossible to accurately trace joint breakages which have been generated in a horizontal direction. Therefore, the electric motor 33 (see FIG. 8) is also controlled concurrently therewith such that the locus of movement of the tip end of the lance 32 is changed from an arc shape to a horizontal straight line.

More specifically, when the lance 32 is brought into the forward tilting posture $P_1$, as the tilt angle of the lance 32 is gradually increased, the controller 49*a* sequentially calculates the target coordinate at the defective portion $M_2$ generated in the horizontal direction, and drives the electric motor 33 to lower the lift mechanism 37 such that the thermal spraying nozzle 32*a* is positioned at the target coordinate.

Next, cases of making repairs on joint breakages generated in the vertical direction at positions deviated from the vertical axis N will be described.

In this case, the controller 49*a* interlocks the operation for hoisting/lowering the lance 32, the operation for deflecting the guide post 31 and the operation for traversing the traversing carriage 4.

More specifically, when the lance 32 is descended in the backward tilting posture $P_2$, the controller 49*a* drives the electric motor 33 (see FIG. 8) to descend the lance 32 while driving the electric motor 46 in accordance with the amount of descent of the lance 32 to extend the rod 45*b* of the derricking device 45, thus tilting the guide post 31 in the direction of arrow S. Concurrently therewith, the controller 49*a* drives the traversing motor 16 to cause the traversing carriage 4 to move in the direction of arrow S. Thus, the tip end of the lance 32 can be descended in parallel with the vertical axis N.

Also, when the lance 32 is descended in the forward tilting posture $P_1$, the controller 49*a* drives the electric motor 33 to descend the lance 32 while driving the electric motor 46 in accordance with the amount of descent of the lance 32 to contract the rod 45*b* of the derricking device 45, thus tilting the guide post 31 in the direction opposite to the arrow S. Concurrently therewith, the controller 49*a* drives the traversing motor 16 to cause the traversing carriage 4 to move in the direction opposite from the arrow S.

Further, when the tip end of the lance 32 is ascended in the backward tilting posture $P_2$ (or the forward tilting posture $P_1$), in parallel with the vertical axis N, the reverse control from the aforementioned control is performed.

Thus, even for joint breakages generated in the vertical direction at positions deviated from the vertical axis N, the tip end of the lance 32 can be accurately traced thereto for making repairs thereon.

Since the lance 32 is configured such that it can be deflected within the carbonizing chamber J as described above, it is possible to make repairs over a wider range within the carbonizing chamber. Furthermore, when the lance 32 is sequentially inserted into charging-holes K from a charging-hole to another charging-hole in the direction of the oven width, it is possible to overcome the problem that un-repaired portions are left within the carbonizing chamber J.

Further, the outer contour dimension of the repairing apparatus 1 is determined such that the cross-sectional contour of the repairing apparatus 1 orthogonal to the longitudinal direction does not interfere with the cross-sectional shape of the path (see S' in FIG. 1) provided through the coal-charging car, at the state where the traveling carriage 3 of the repairing apparatus 1 has been revolved to the standby position parallel to the rails 2, and the guide post 31 is folded on the traveling carriage 3. Therefore, when the repairing apparatus 1 is on standby, the coal-charging car can freely travel on the repairing apparatus 1.

Further, while in the aforementioned embodiment, it has been described that the lance 32 including the thermal spraying nozzle 32*a* is used for performing repairing operations, a surveillance camera or measuring device may be provided within the lance 32 to utilize the repairing apparatus as an inspection device.

INDUSTRIAL APPLICABILITY

The coke oven repairing apparatus according to the present invention can be preferably utilized for making repairs on the oven walls within a coke oven carbonizing chamber.

The invention claimed is:

1. A coke-oven repairing apparatus comprising: a traveling carriage which travels in the direction of coke oven battery with the carriage straddled on rails placed on the top of a coke oven; a traversing carriage provided on said traveling carriage, which moves in the direction orthogonal to the direction of coke oven battery; and a working device for making repairs on the oven walls within the coke oven which is mounted on said traversing carriage, said working device includes:

a guide post which stands on said traversing carriage, and is also coupled, at its lower end portion, to a supporting portion provided on the traversing carriage through a pivot shaft;

a lance which ascends or descends along the guide post; and a lance oscillating means which oscillates said guide post between a forward-tilted posture and a backward-tilted posture using said pivot shaft as the fulcrum to tilt said lance inserted in a coke-oven carbonizing chamber through a charging-hole, within the carbonizing chamber, wherein the lance oscillating means include:

an extendable device which extends and contracts and is coupled to the guide post and the traversing carriage; and a control device which sets a fulcrum of the lance to near the center of the charging-hole and also to near the depthwise center of the charging-hole, and interlocks a driving of the extendable device and a driving of the traversing carriage for maximizing the oscillating angle of the lance inserted in the carbonizing chamber, within a range which prevents the lance from contacting with the charging hole.

2. The coke-oven repairing apparatus according to claim 1, wherein, said control device controls the amount of ascent or descent of said lance such that the locus of movement of the tip end of said lance which is swung in the direction of oven length to a straight line when said lance is tilted.

3. The coke-oven repairing apparatus according to claim 1, wherein said control device is configured to move the tip end of said lance in the vertical direction within the carbonizing chamber, by controlling the tilted angle of said lance while ascending or descending said lance tilted in the direction of oven length.

4. The coke-oven repairing apparatus according to claim 1, wherein said traveling carriage includes a traveling-carriage lift mechanism which lifts up the traveling carriage from said rails and a slewing device which revolves said traveling carriage being lifted up from said rails to a standby position parallel to the rails.

5. The coke-oven repairing apparatus according to claim 4, wherein said traveling-carriage lift mechanism is constituted by a pedestal hung from the bottom portion of said traveling carriage and lifting cylinders coupled to the underframe of said traveling carriage and to said pedestal.

6. The coke-oven repairing apparatus according to claim 1, wherein said extendable device also serves as a derricking device for raising or folding said guide post on said traveling carriage.

7. The coke-oven repairing apparatus according to claim 6, wherein the outline dimension of said reparing apparatus is determined such that the cross-sectional contour of said repairing apparatus orthogonal to the longitudinal direction does not interfere with the cross-sectional shape of a path opening portion which is penetrated through said coal-charging car in the direction of the travel thereof, at the state where said traveling carriage has been revolved to a standby position parallel to the rails and said guide post is folded on said traveling carriage.

8. The coke-oven repairing apparatus according to claim 1, wherein said traveling carriage is configured to travel using rails for a coal-charging car which travels on the oven.

* * * * *